US006883404B2

(12) United States Patent
Hsien

(10) Patent No.: US 6,883,404 B2
(45) Date of Patent: Apr. 26, 2005

(54) WRENCH HAVING ROTATION ADJUSTMENT EFFECT

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 6 days.

(21) Appl. No.: 10/623,325

(22) Filed: Jul. 17, 2003

(65) Prior Publication Data

US 2005/0011317 A1 Jan. 20, 2005

(51) Int. Cl.[7] ..... B25B 13/00
(52) U.S. Cl. ..... 81/125.1; 81/177.9
(58) Field of Search ..... 81/125.1, 177.7, 81/177.8, 177.9, 124.5; 403/92

(56) References Cited

U.S. PATENT DOCUMENTS 1,448,962 A * 3/1923 Hughes ..... 81/177.7
2,939,351 A * 6/1960 Falk ..... 81/124.5
4,530,262 A * 7/1985 Pownall ..... 81/177.9
4,581,959 A * 4/1986 Troiano ..... 81/177.9
5,492,040 A * 2/1996 Bellas ..... 81/125.1
6,186,033 B1 * 2/2001 Faro, Sr. ..... 81/177.7
2004/0139828 A1 * 7/2004 Chang ..... 81/177.9

* cited by examiner

*Primary Examiner*—James G. Smith

(57) ABSTRACT

A wrench includes a first handle provided with a first rotation seat, and a second handle provided with a second rotation seat rotatably mounted on the first rotation seat of the first handle. Thus, the first rotation seat of the first handle can be rotated relative to the second rotation seat of the second handle, so that the first handle has a driving face inclined with that of the second handle, thereby facilitating the user operating the first handle or the second handle to rotate the workpiece.

13 Claims, 5 Drawing Sheets

WRENCH HAVING ROTATION ADJUSTMENT EFFECT

BACKGROUND OF THE INVENTION

1. Field of the Invention

The present invention relates to a wrench, and more particularly to a wrench having an adjustment effect of different rotation angles.

2. Description of the Related Art

A conventional wrench in accordance with the prior art shown in FIG. 7 comprises a handle 70, and a driving head 72 pivotally mounted on an end of the handle 70 by a pivot pin 74. Thus, the driving head 72 is pivoted relative to the handle 70 to change the included angle between the driving head 72 and the handle 70, thereby facilitating the user operating the driving head 72 to rotate a workpiece, such as a nut. However, the user cannot identify the included angle between the driving head 72 and the handle 70 exactly, thereby causing inconvenience in operation.

SUMMARY OF THE INVENTION

The primary objective of the present invention is to provide a wrench having an adjustment effect of different rotation angles.

Another objective of the present invention is to provide a wrench having an exact identification function of different rotation angles.

A further objective of the present invention is to provide a wrench, wherein the first rotation seat of the first handle can be rotated relative to the second rotation seat of the second handle, so that the first handle has a driving face inclined with that of the second handle, thereby facilitating the user operating the first handle or the second handle to rotate the workpiece.

A further objective of the present invention is to provide a wrench, wherein the inclined angle between the first rotation seat of the first handle and the second rotation seat of the second handle is indicated by the first indication portions of the first handle and the second indication portions of the second handle to produce a viewable effect, thereby facilitating the user identifying the rotation angle exactly.

A further objective of the present invention is to provide a wrench, wherein the positioning ball of the urging device is moved to be snapped into and locked in either one of the locking holes of the first rotation seat of the first handle during rotation of the first rotation seat of the first handle relative to the second rotation seat of the second handle, so as to produce an audible effect successively during movement of the positioning ball of the urging device, thereby facilitating the user identifying the rotation angle exactly.

A further objective of the present invention is to provide a wrench, wherein the thumb of the user's hand can be rested on the first stop portion or the second stop portion to prevent the user's hand from slipping from the first handle or the second handle during operation.

In accordance with the present invention, there is provided a wrench, comprising a first handle, and a second handle combined with the first handle, wherein:

the first handle has a first end provided with a first rotation seat; and the second handle has a first end provided with a second rotation seat rotatably mounted on the first rotation seat of the first handle.

Further benefits and advantages of the present invention will become apparent after a careful reading of the detailed description with appropriate reference to the accompanying drawings.

DETAILED DESCRIPTION OF THE INVENTION

Figure 1:
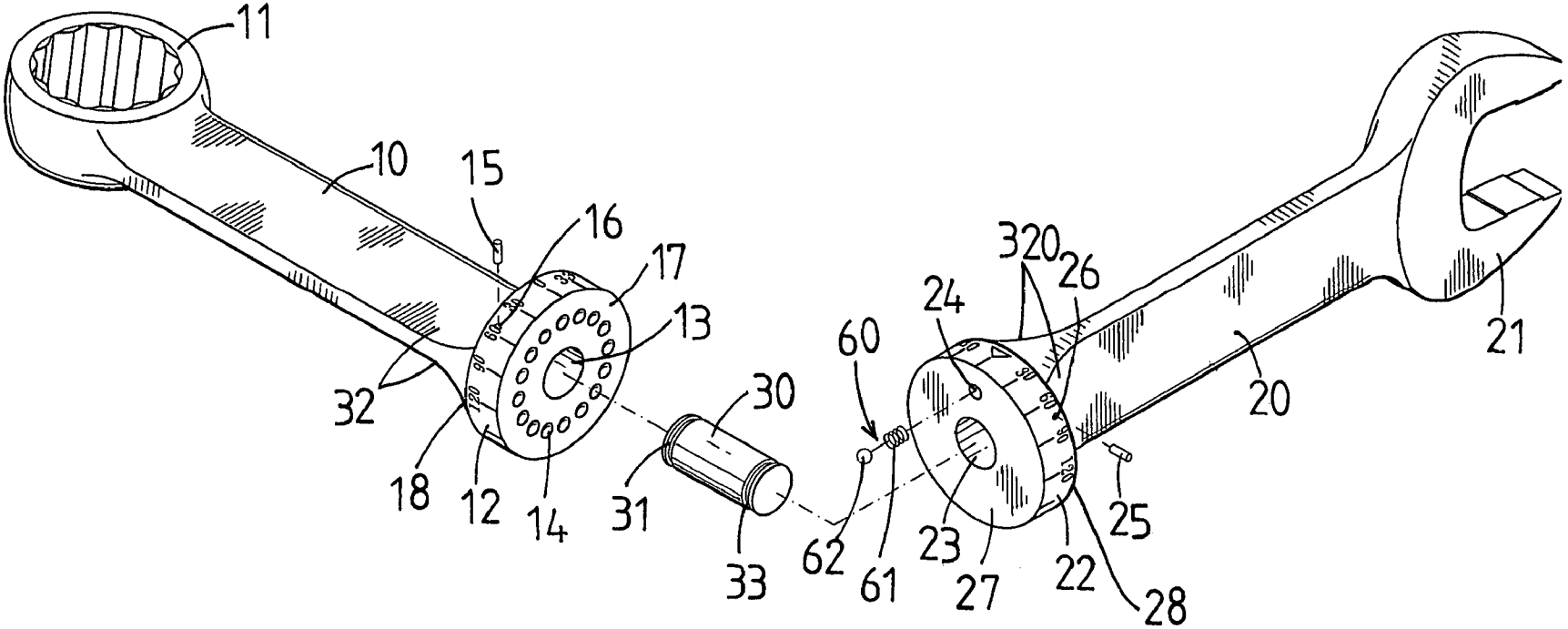
FIG. 1 is an exploded perspective view of a wrench in accordance with the preferred embodiment of the present invention.
Figure 2:
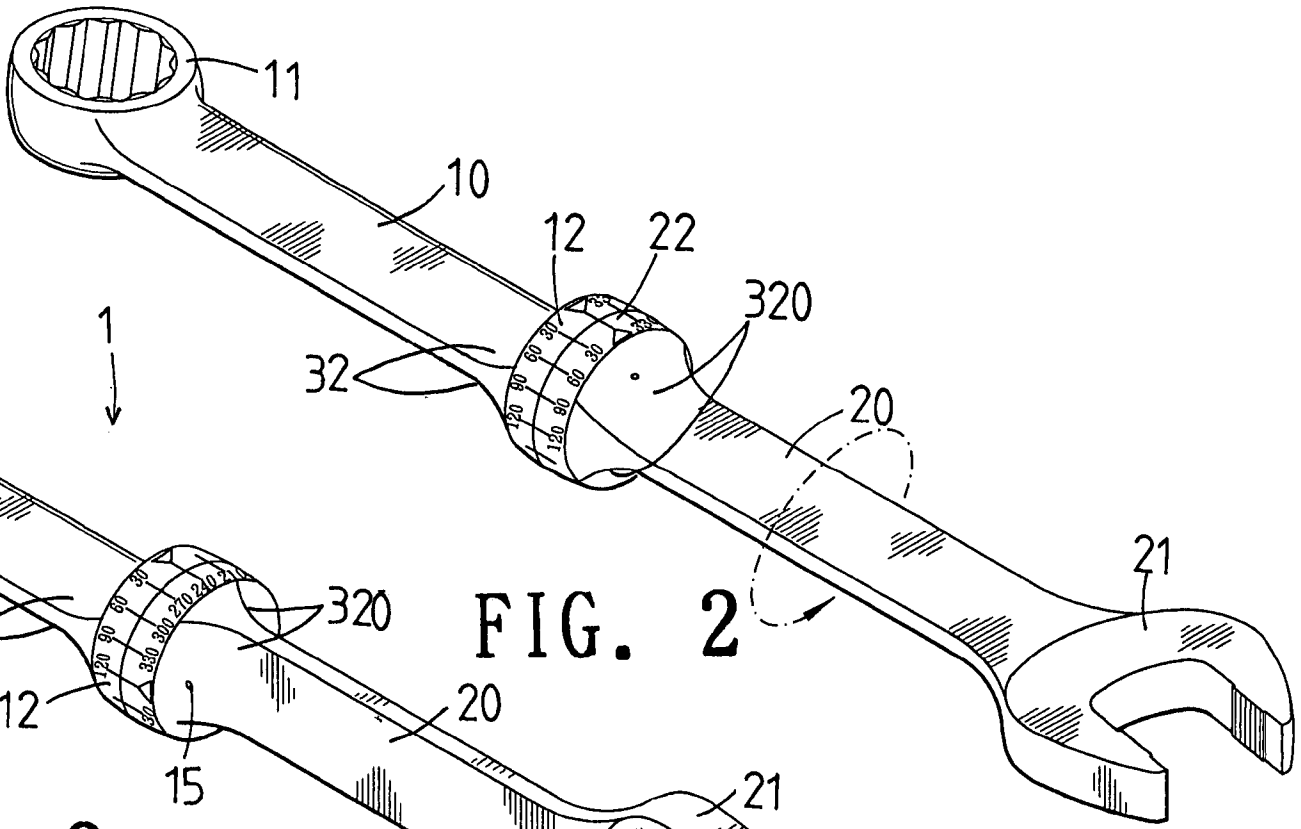
FIG. 2 is a perspective assembly view of the wrench in accordance with the preferred embodiment of the present invention.
Figure 3:
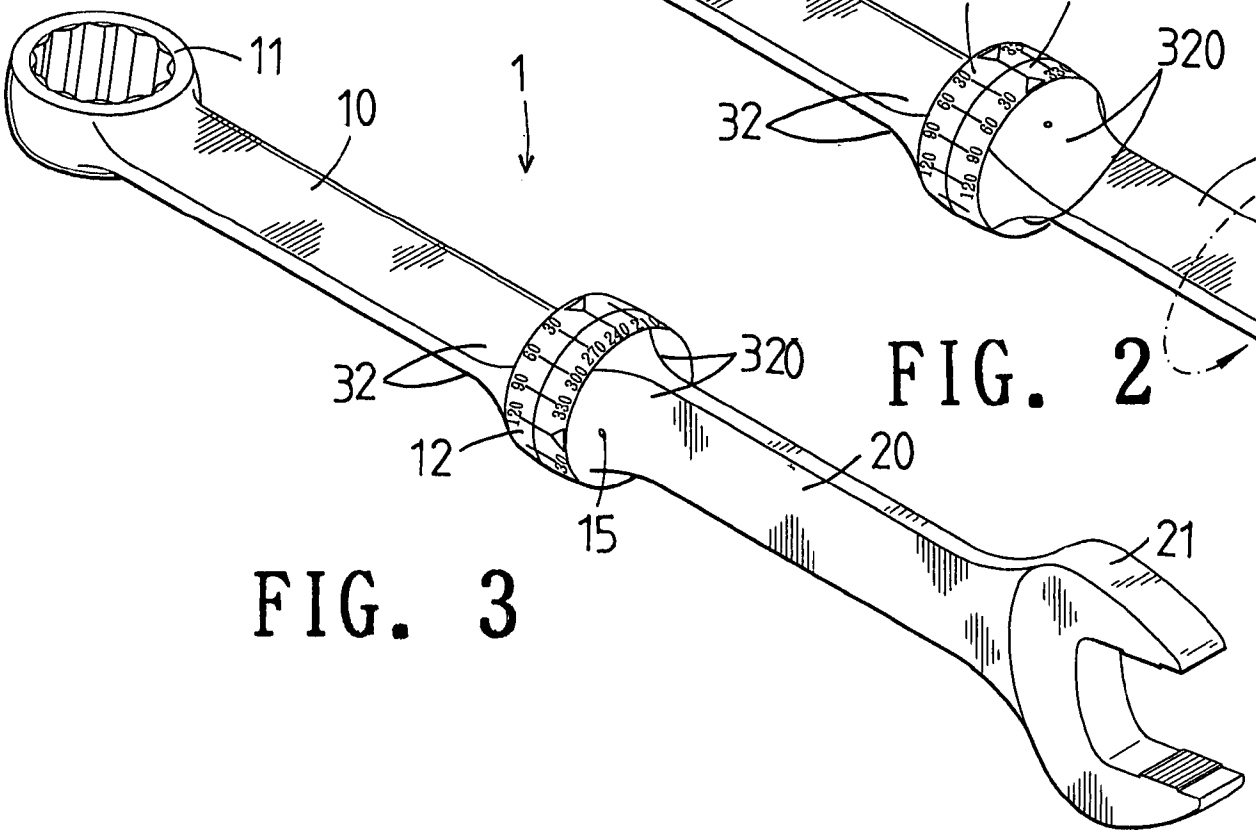
FIG. 3 is a schematic operational view of the wrench as shown in FIG. 2 in use.

Referring to the drawings and initially to FIGS. 1–3, a wrench 1 in accordance with the preferred embodiment of the present invention comprises a first handle 10, and a second handle 20 combined with the first handle 10.

The first handle 10 has a first end provided with a first rotation seat 12 and a second end provided with a closed driving head 11. The first rotation seat 12 of the first handle 10 has a cylindrical shape and has a central portion formed with a first receiving hole 13. The first rotation seat 12 of the first handle 10 has a peripheral wall provided with a plurality of first indication portions 18 and formed with a first positioning hole 16 communicating with the first receiving hole 13. The first rotation seat 12 of the first handle 10 has an end face 17 formed with a plurality of locking holes 14 surrounding the first receiving hole 13 in an annular manner. The first rotation seat 12 of the first handle 10 has a side formed with an arcuate first stop portion 32, so that the thumb of the user's hand can be rested on the first stop portion 32 to prevent the user's hand from slipping from the first handle 10 during operation.

The second handle 20 has a first end provided with a second rotation seat 22 rotatably mounted on the first rotation seat 12 of the first handle 10 and a second end provided with an opened driving head 21. The second rotation seat 22 of the second handle 20 has a cylindrical shape and has a central portion formed with a second receiving hole 23 aligning with the first receiving hole 13. The second rotation seat 22 of the second handle 20 has a peripheral wall provided with a plurality of second indication portions 28 and formed with a second positioning hole 26 communicating with the second receiving hole 23. The second rotation seat 22 of the second handle 10 has an end face 27 formed with a receiving chamber 24. The second rotation seat 22 of the second handle 20 has a side formed with an arcuate second stop portion 320, so that the thumb of the user's hand can be rested on the second stop portion 320 to prevent the user's hand from slipping from the second handle 20 during operation.

The wrench 1 further comprises a rotation shaft 30 rotatably mounted between the first rotation seat 12 of the first handle 10 and the second rotation seat 22 of the second handle 10, so that the first rotation seat 12 of the first handle 10 and the second rotation seat 22 of the second handle 10 can be rotated relative each other.

The rotation shaft 30 has a first end rotatably mounted in the first receiving hole 13 of the first rotation seat 12 of the first handle 10 and formed with a first annular groove 31 aligning with the first positioning hole 16. The rotation shaft 30 has a second end rotatably mounted in the second receiving hole 23 of the second rotation seat 22 of the second handle 20 and formed with a second annular groove 33 aligning with the second positioning hole 26.

The wrench 1 further comprises a first positioning pin 15 mounted in the first positioning hole 16 of the first rotation seat 12 of the first handle 10 and having a distal end slidably mounted in the first annular groove 31 of the rotation shaft 30 to prevent the first rotation seat 12 of the first handle 10 from detaching from the rotation shaft 30.

The wrench 1 further comprises a second positioning pin 25 mounted in the second positioning hole 26 of the second rotation seat 22 of the second handle 20 and having a distal end slidably mounted in the second annular groove 33 of the rotation shaft 30 to prevent the second rotation seat 22 of the second handle 20 from detaching from the rotation shaft 30.

The wrench 1 further comprises an urging device 60 mounted between the first rotation seat 12 of the first handle 10 and the second rotation seat 22 of the second handle 10, so that the first rotation seat 12 of the first handle 10 and the second rotation seat 22 of the second handle 10 can be locked with each other temporarily.

The urging device 60 includes a positioning ball 62 mounted in the receiving chamber 24 of the second rotation seat 22 of the second handle 10 and locked in one of the locking holes 14 of the first rotation seat 12 of the first handle 10, and a spring 61 mounted in the receiving chamber 24 of the second rotation seat 22 of the second handle 10 and urged on the positioning ball 62.

In operation, the first handle 10 is initially parallel with the second handle 20 as shown in FIG. 2. Then, the second rotation seat 22 of the second handle 20 can be rotated relative to the first rotation seat 12 of the first handle 10 as shown in FIGS. 2 and 3, so that the second handle 20 is vertical to the first handle 10, thereby facilitating the user operating the second handle 20 to drive and rotate the first handle 10.

Figure 5:
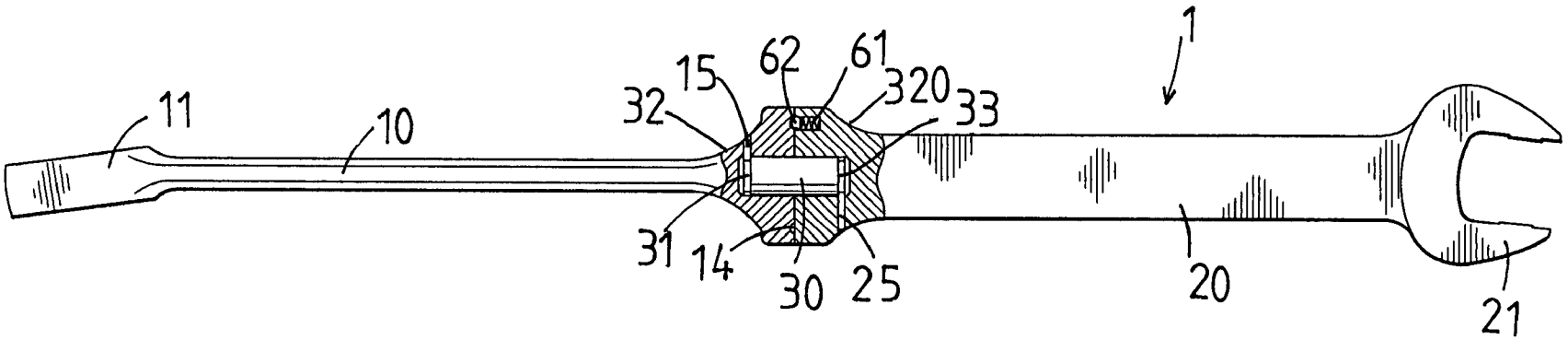
FIG. 5 is a schematic operational view of the wrench as shown in FIG. 4 in use.
Figure 4:
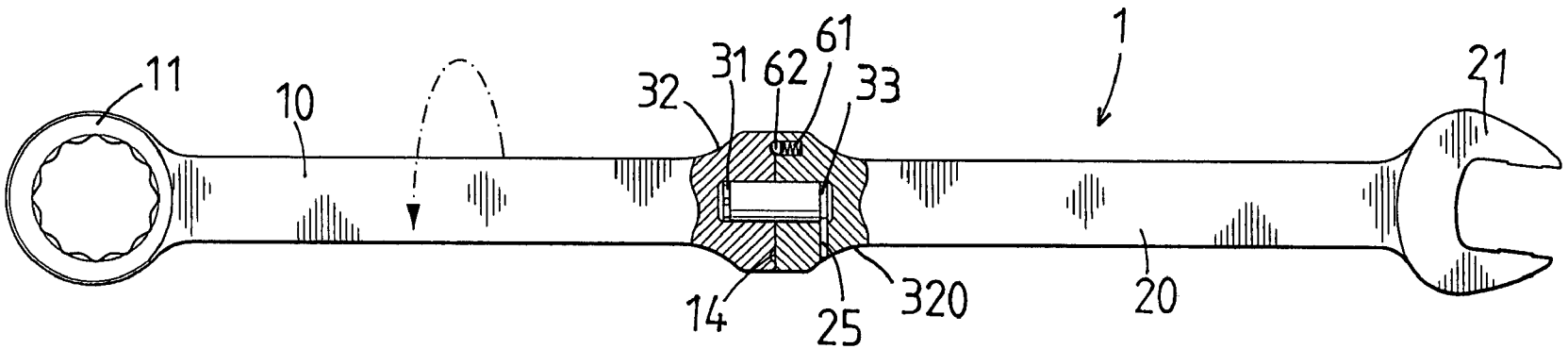
FIG. 4 is a top plan partially cross-sectional view of the wrench as shown in FIG. 2.

Alternatively, the first rotation seat 12 of the first handle 10 can be rotated relative to the second rotation seat 22 of the second handle 20 as shown in FIGS. 4 and 5, so that the first handle 10 is vertical to the second handle 20, thereby facilitating the user operating the first handle 10 to drive and rotate the second handle 20.

Figure 6:
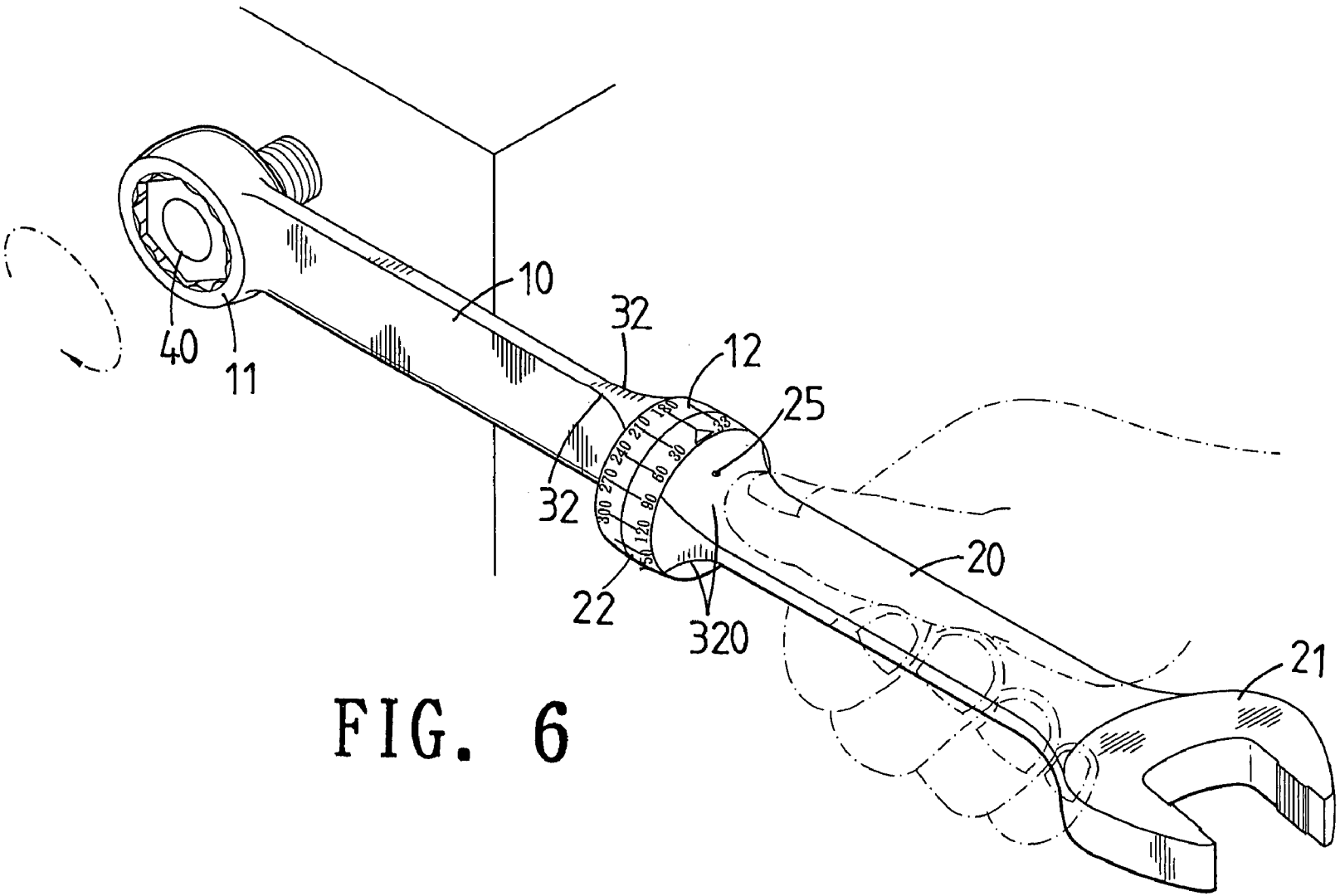
FIG. 6 is a schematic operational view of the wrench as shown in FIG. 2 in use.
Figure 7:
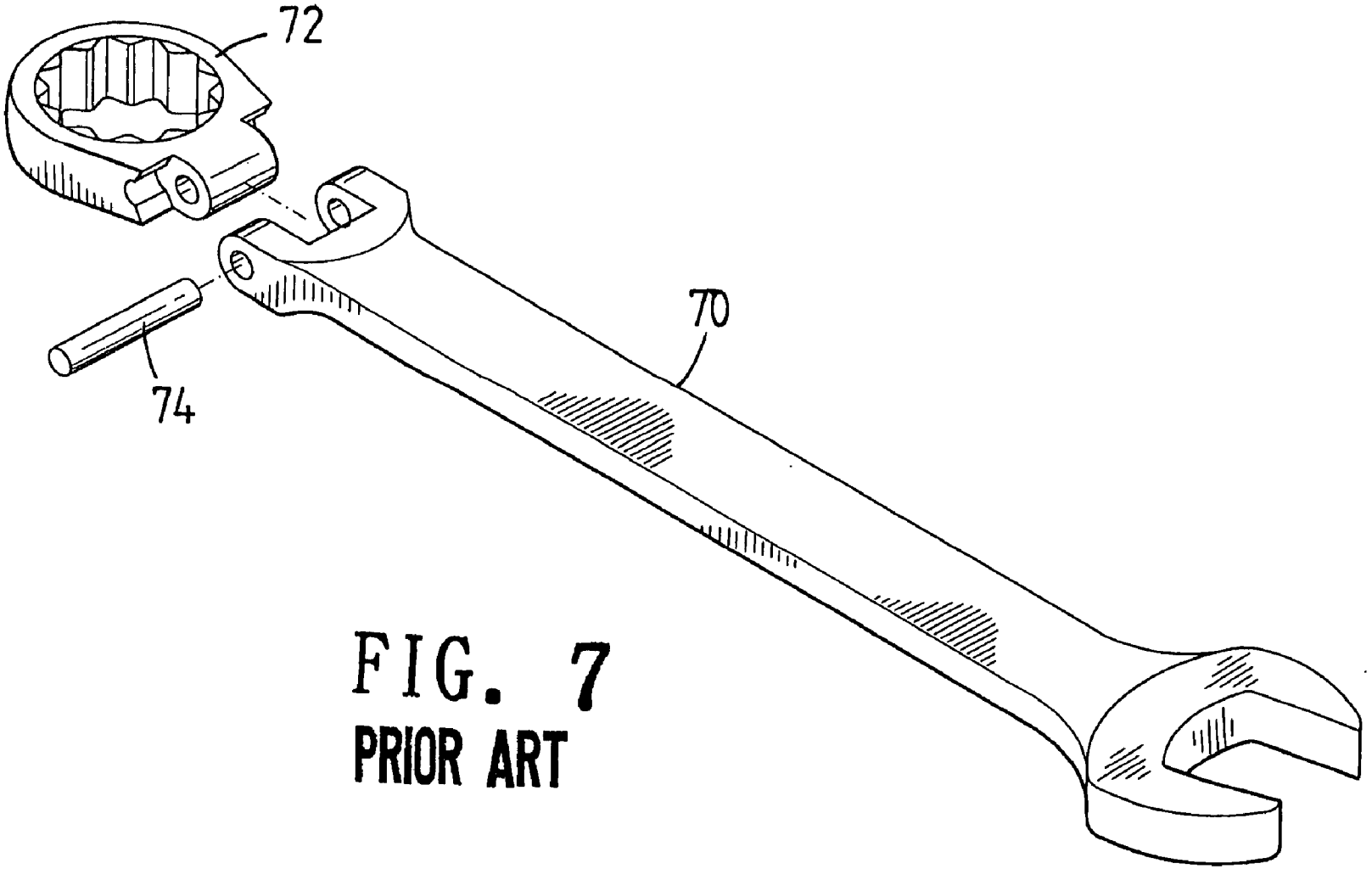
FIG. 7 PRIOR ART
FIG. 7 is an exploded perspective view of a conventional wrench in accordance with the prior art.

As shown in FIG. 6, the first handle 10 is vertical to the second handle 20, and the second handle 20 is operated to drive and rotate the first handle 10 so as to rotate a workpiece, such as a nut 40, so that the wrench can be used to rotate the nut 40 easily and conveniently. At this time, the thumb of the user's hand can be rested on the second stop portion 320 of the second handle 20 to prevent the user's hand from slipping from the second handle 20 during operation.

Accordingly, the first rotation seat 12 of the first handle 10 can be rotated relative to the second rotation seat 22 of the second handle 20, so that the first handle 10 has a driving face inclined with that of the second handle 20, thereby facilitating the user operating the first handle 10 or the second handle 20 to rotate the workpiece.

In addition, the inclined angle between the first rotation seat 12 of the first handle 10 and the second rotation seat 22 of the second handle 20 is indicated by the first indication portions 18 of the first handle 10 and the second indication portions 28 of the second handle 20 to produce a viewable effect, thereby facilitating the user identifying the rotation angle exactly.

Further, the positioning ball 62 of the urging device 60 is moved to be snapped into and locked in either one of the locking holes 14 of the first rotation seat 12 of the first handle 10 during rotation of the first rotation seat 12 of the first handle 10 relative to the second rotation seat 22 of the second handle 20, so as to produce an audible effect successively during movement of the positioning ball 62 of the urging device 60, thereby facilitating the user identifying the rotation angle exactly.

Further, the thumb of the user's hand can be rested on the first stop portion 32 of the first handle 10 or the second stop portion 320 of the second handle 20 to prevent the user's hand from slipping from the first handle 10 or the second handle 20 during operation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A wrench, comprising a first handle, and a second handle combined with the first handle, wherein:

the first handle has a first end provided with a first rotation seat;

the second handle has a first end provided with a second rotation seat rotatably mounted on the first rotation seat of the first handle;

the wrench further comprises a rotation shaft rotatably mounted between the first rotation seat of the first handle and the second rotation seat of the second handle;

the first rotation seat of the first handle has a central portion formed with a first receiving hole, the second rotation seat of the second handle has a central portion formed with a second receiving hole aligning with the first receiving hole, the rotation shaft has a first end rotatably mounted in the first receiving hole of the first rotation seat of the first handle, and a second end rotatably mounted in the second receiving hole of the second rotation seat of the second handle;

the first rotation seat of the first handle has a peripheral wall formed with a first positioning hole communicating with the first receiving hole, the first end of the rotation shaft is formed with a first annular groove aligning with the first positioning hole, and the wrench further comprises a first positioning pin mounted in the first positioning hole of the first rotation seat of the first handle and having a distal end slidably mounted in the first annular groove of the rotation shaft to prevent the first rotation seat of the first handle from detaching from the rotation shaft.

2. The wrench in accordance with claim 1, wherein the second rotation seat of the second handle has a peripheral wall formed with a second positioning hole communicating with the second receiving hole, the second end of the rotation shaft is formed with a second annular groove aligning with the second positioning hole, and the wrench further comprises a second positioning pin mounted in the second positioning hole of the second rotation seat of the second handle and having a distal end slidably mounted in the second annular groove of the rotation shaft to prevent the second rotation seat of the second handle from detaching from the rotation shaft.

3. The wrench in accordance with claim 1, wherein the first handle has a second end provided with a closed driving head.

4. The wrench in accordance with claim 1, wherein the first rotation seat of the first handle has a cylindrical shape.

5. The wrench in accordance with claim 1, wherein the first rotation seat of the first handle has a peripheral wall provided with a plurality of first indication portions.

6. The wrench in accordance with claim 1, wherein the first rotation seat of the first handle has a side formed with an arcuate first stop portion.

7. The wrench in accordance with claim 1, wherein the second handle has a second end provided with an opened driving head.

8. The wrench in accordance with claim 1, wherein the second rotation seat of the second handle has a cylindrical shape.

9. The wrench in accordance with claim 1, wherein the second rotation seat of the second handle has a peripheral wall provided with a plurality of second indication portions.

10. The wrench in accordance with claim 1, wherein the second rotation seat of the second handle has a side formed with an arcuate second stop portion.

11. The wrench in accordance with claim 1, further comprising an urging device mounted between the first rotation seat of the first handle and the second rotation seat of the second handle, so that the first rotation seat of the first handle and the second rotation seat of the second handle can be locked with each other temporarily.

12. The wrench in accordance with claim 11, wherein the first rotation seat of the first handle has an end face formed with a plurality of locking holes, the second rotation seat of the second handle has an end face formed with a receiving chamber, and the urging device includes a positioning ball mounted in the receiving chamber of the second rotation seat of the second handle and locked in one of the locking holes of the first rotation seat of the first handle, and a spring mounted in the receiving chamber of the second rotation seat of the second handle and urged on the positioning ball.

13. The wrench in accordance with claim 1, wherein the first rotation seat of the first handle can be rotated relative to the second rotation seat of the second handle, so that the first handle has a driving face inclined with that of the second handle.

* * * * *